United States Patent [19]

Cornell

[11] 3,998,115

[45] Dec. 21, 1976

[54] MUTLIPLE RIP-SAWING METHOD AND APPARATUS

[76] Inventor: Cyrus J. Cornell, P.O. Box 18, Laceyville, Pa. 18623

[22] Filed: Nov. 11, 1975

[21] Appl. No.: 630,818

[52] U.S. Cl. ..... 83/56; 83/435.2; 83/425.3; 83/429

[51] Int. Cl.[2] ..... B27B 5/00; B27B 25/00

[58] Field of Search ..... 83/435.2, 56, 425, 425.1, 83/425.2, 425.3, 429

[56] References Cited

UNITED STATES PATENTS

| | | | |
|---|---|---|---|
| 2,936,800 | 5/1960 | Eschenburg et al. | 83/435.2 X |
| 3,788,174 | 1/1974 | Morse et al. | 83/425.2 X |

*Primary Examiner*—Willie G. Abercrombie
*Attorney, Agent, or Firm*—Richard G. Stephens

[57] ABSTRACT

Improved "climb-cut" wood sawing machinery, including a top-arbor, single-arbor gang-blade ripping saw, includes means for controlling the disposition of feed-roll drive chain slack to eliminate accidental high-speed ejection of wood pieces. A feed roll motor drives the first of a series of cascaded chain-driven feed rolls, and a slip clutch also driven by the feed motor applies a retarding torque to the last feed roll of the series. In alternative embodiments disclosed, the retarding torque is instead applied by a brake, a separate hydraulic motor or a separate electric motor.

18 Claims, 15 Drawing Figures

67a
67
66
85
85'
83
84
30f
97
96
90
86
29
92
91a
38b
91
46
45
38c'
93a
30a
47
102
84
PS
40a'
101a
99
30g
89
104
100
40b'
103a
106
88'
98
88
87
SC
105
2a
2a
32
72b
31a
31
105
116
114
113
87
115
112
SC
109
111
110
40c
30a

MUTLIPLE RIP-SAWING METHOD AND APPARATUS

This invention relates to method and apparatus for multiple-blade rip-sawing of wood. While the invention has particular utility for ripping cants into pallet stock and will be explained in connection therewith, it will become apparent that the invention is useful for many other sawing applications. Pallets widely used in material-handling operations usually include three or four stringer boards of perhaps 2 to 4 inch cross-section and 3 or 4 feet length spaced parallel to each other, with deck boards typically of 1 by 4 inch cross-section interconnecting the upper and often the lower edges of the stringer boards. Cants, or rough-sawn logs of various lengths which typically vary in cross-section from say 4 × 4 inch to 16 × 16 inch, are commonly first cut to standard lengths, such as 4 feet, by a trim and cut-to-length saw, and then re-sawn into pallet stringers and deck boards by a multiple-blade "resaw." One widely-used form of multiple resaw includes upper and lower motor-driven arbors each carrying a plurality of spaced-apart circular saw blades, with each blade on the upper arbor operating in a vertical plane common to that of a respective blade on the lower arbor. As power-operated feed rolls push a cant endwise between the arbors, the cant is sawed into a plurality of elongated strips, with the thickness of each strip being dependent upon the spacings between the saw blades on their respective arbors. One object of the present invention is to provide an improved multiple-ripping saw which is less expensive to manufacture and to operate. A multiple ripping saw which requires only a single arbor can be manufactured substantially less expensively, and thus one more specific object of the invention is to provide an improved multiple ripping saw which requires only a single arbor, and hence only a single arbor motor-drive and a single set of circular saw blades. A need to use only a single arbor drive-motor and a single set of saw blades also provides very significant economies.

If a single saw arbor is to be used, a choice must be made in the direction of blade rotation relative to the direction in which wood is fed to and past the blades. A very large majority of single arbor saws use a direction of blade rotation such that tangential movement of the blades through the wood is opposite to the wood feed direction. It has been known that an opposite arrangement sometimes called a "climb cut," wherein blade tangential movement is in the same direction as wood feed, can result in substantially greater saw tooth life. An important object of the present invention is to provide an improved single-arbor gang-blade ripping saw which uses climb cutting, and hence provides substantially greater blade tooth life. As well as providing greater tooth life, the use of climb cutting requires less horsepower, saving electrical energy as well as allowing the use of less expensive motors, and another object of the present invention is to provide an improved single-arbor gang-blade ripping saw having those advantages.

While the fact that climb cutting can increase tooth life has been known, and climb-cutting has been commonly used on one arbor of a two-arbor resaw, the art has avoided the use of climb cutting with single arbor saws, mainly because of a dangerous phenomenon which tends to occur. The use of climb cutting with a single-arbor resaw has frequently resulted in dangerous occurrences wherein pieces of wood being cut are "grabbed" by one or more of the rapidly rotating saw blades and flung forwardly from the saw at lethal velocities. Pieces of wood have been known to have been ejected with sufficient force to penetrate concrete block walls. Such occurrences are obviously extremely dangerous to personnel and nearby objects. Another important object of the invention is to provide an improved single-arbor gang-blade saw in which such high-speed accidental ejection of pieces of wood is effectively prevented.

Various practical considerations tend to dictate that the plurality of feed rolls used in a gang rip saw be chain driven. As will become clear from an ensuing explanation, the dangerous high-speed ejection of wood pieces tends to occur because of the presence of slack in feed roll drive chains. Various strategms which conceivably might be used to remove chain slack tend to be impractical, and a more specific object of the invention is to provide improved climb-cutting saw machinery wherein drive chain slack need not be removed, but can be automatically controlled so as to obviate the problem of high-speed forward ejection of wood pieces.

While the invention is deemed principally useful with single-arbor saws, it also finds ready utility with double-arbor saws wherein both gangs of blades perform climb cutting, and provision of such an improved double-arbor gang-blade ripping saw is another object of the invention.

Other objects of the invention will in part be obvious and will in part appear hereinafter.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

For a fuller understanding of the nature and objects of the invention reference should be had to the following detailed description taken in connection with the accompanying drawings, in which.

Figures 2, 2A:
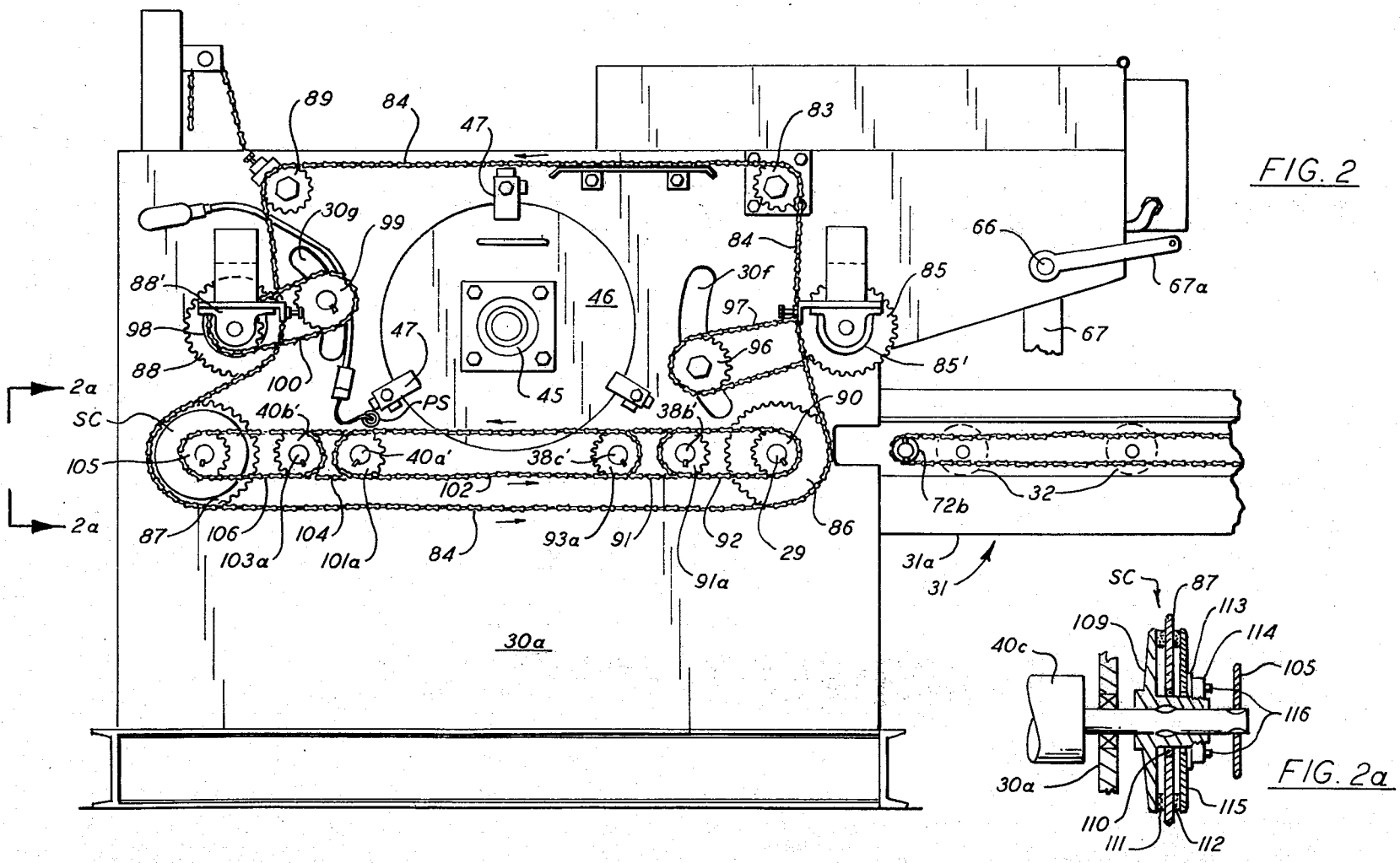
FIG. 2 is one side view of the assembly of FIG. 1.

FIG. 2*a* is a diagrammatic view taken at lines 2*a*—2*a* in FIG. 2.

Figure 1:
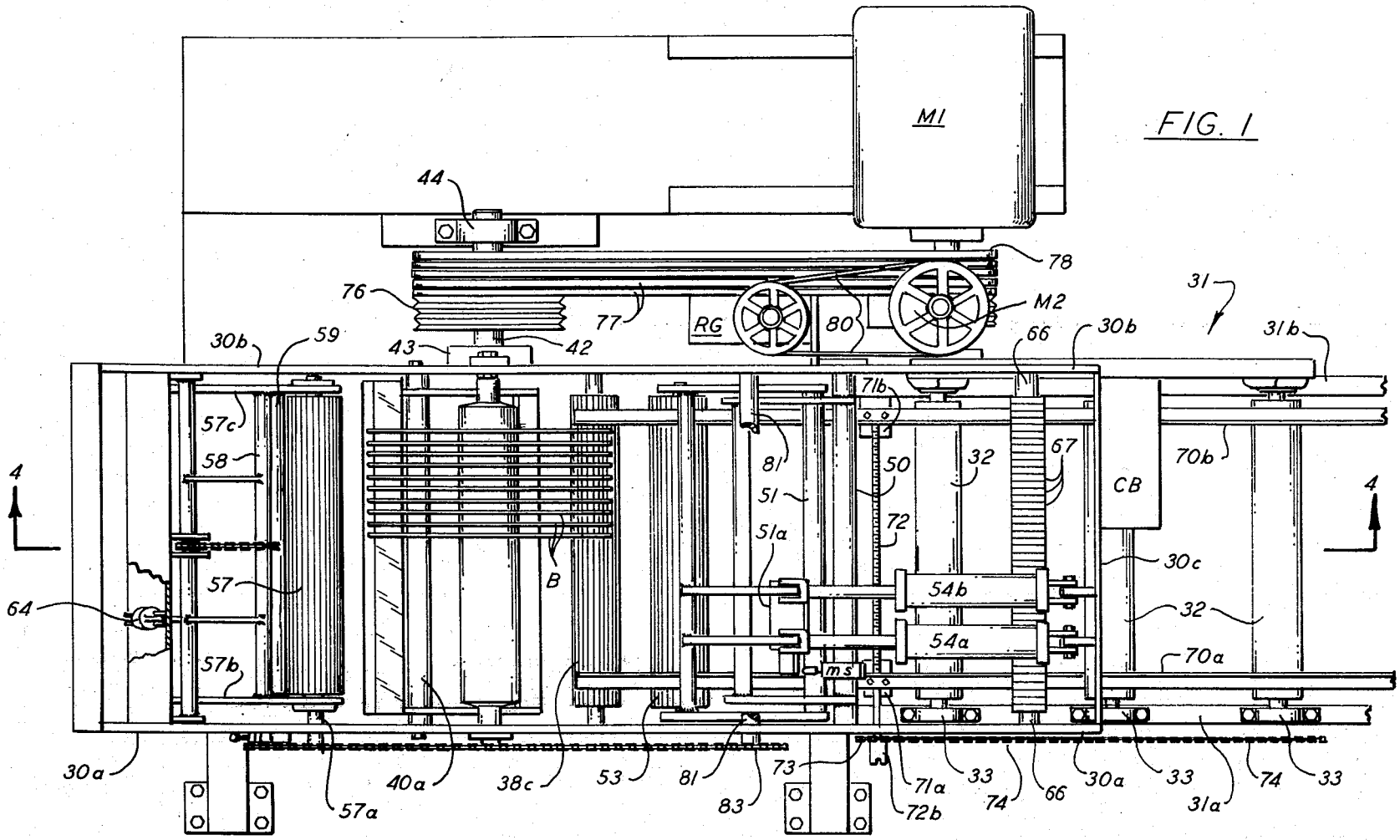
FIG. 1 is a plan view of one form of saw assembly constructed in accordance with the present invention.
Figure 3:
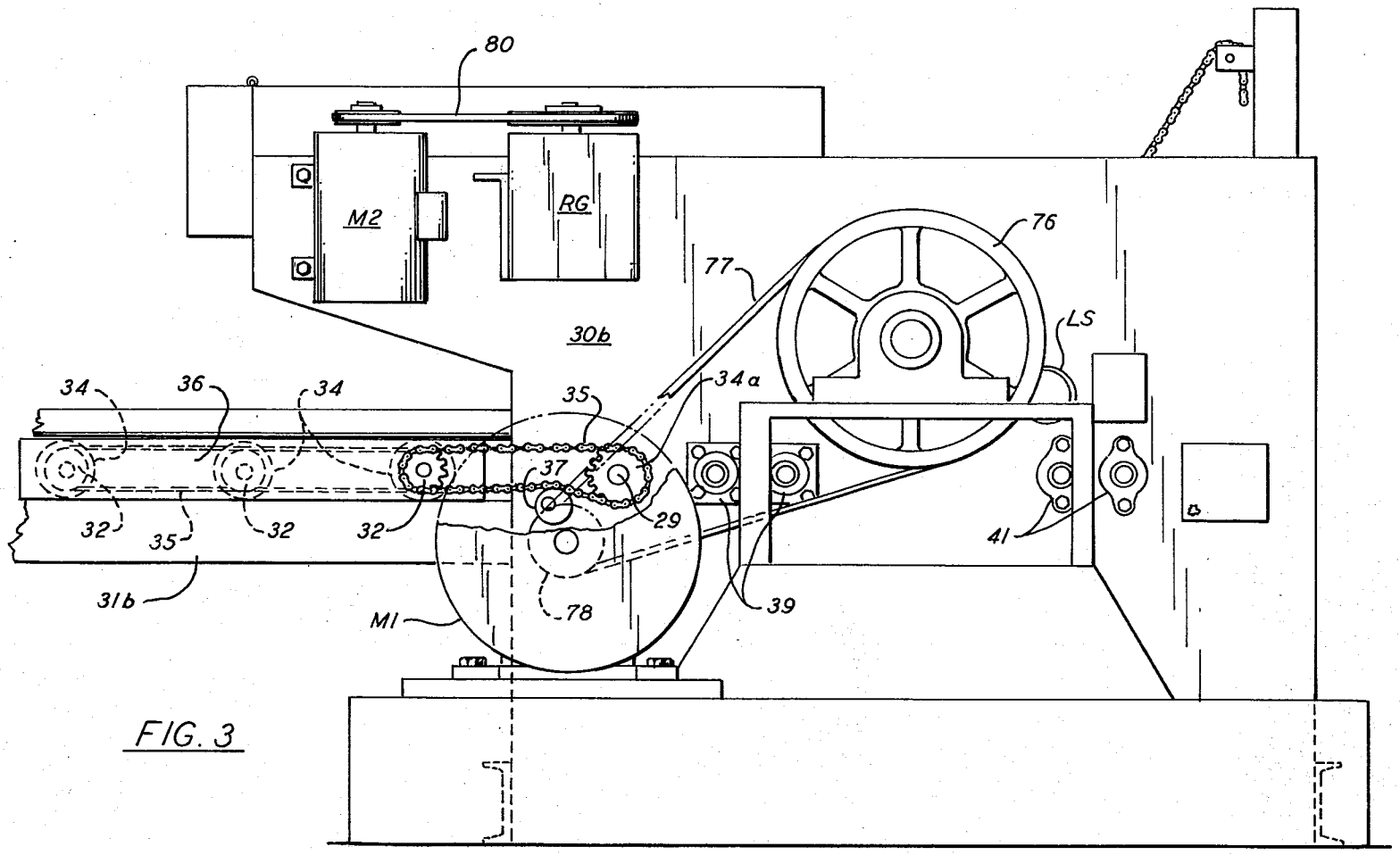

FIG. 3 is a second side view of the assembly of FIG. 1, taken from the opposite side from that of FIG. 2.

Figure 4:
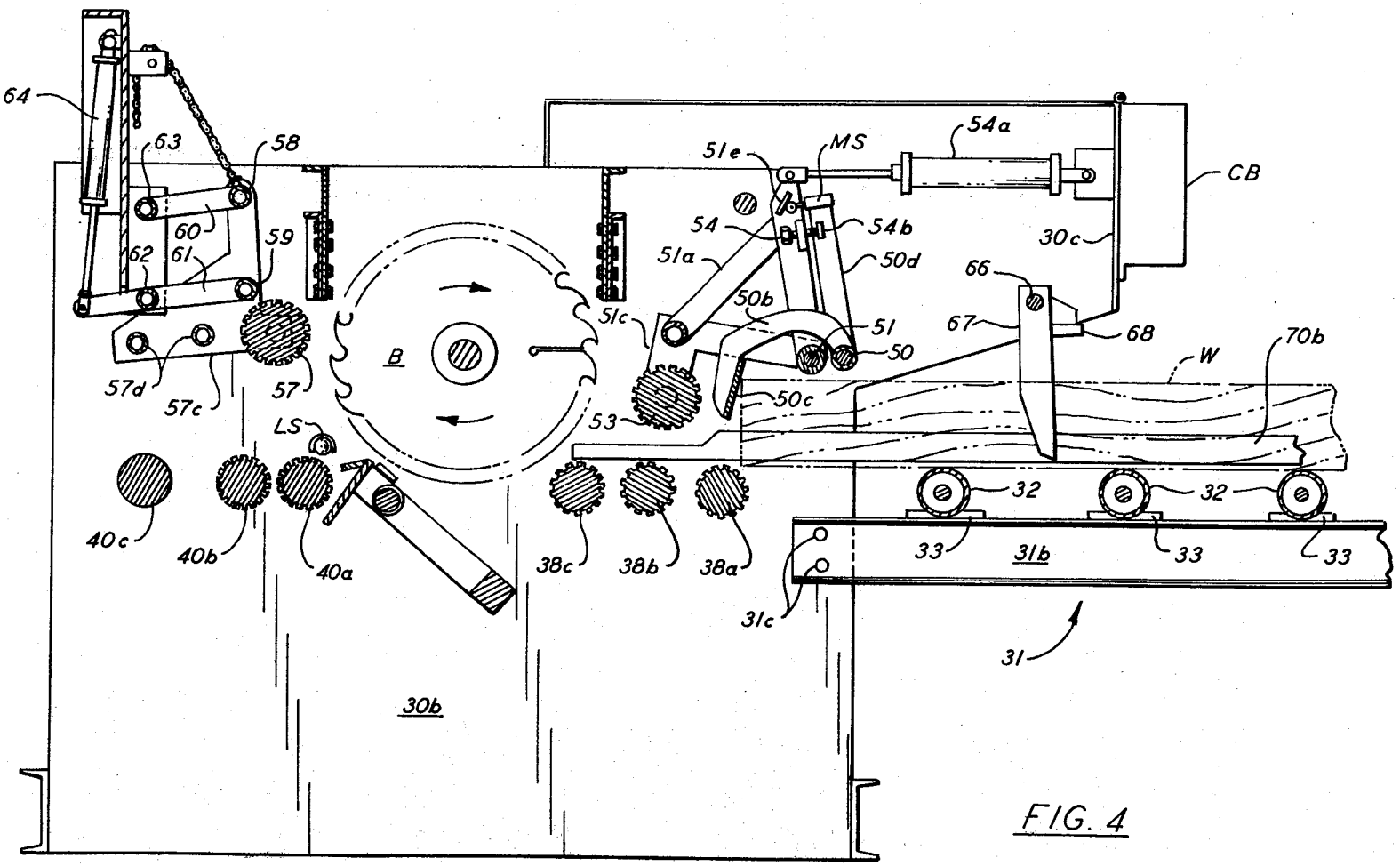

FIG. 4 is a section view taken at lines 4—4 in FIG. 1.

Figure 5:
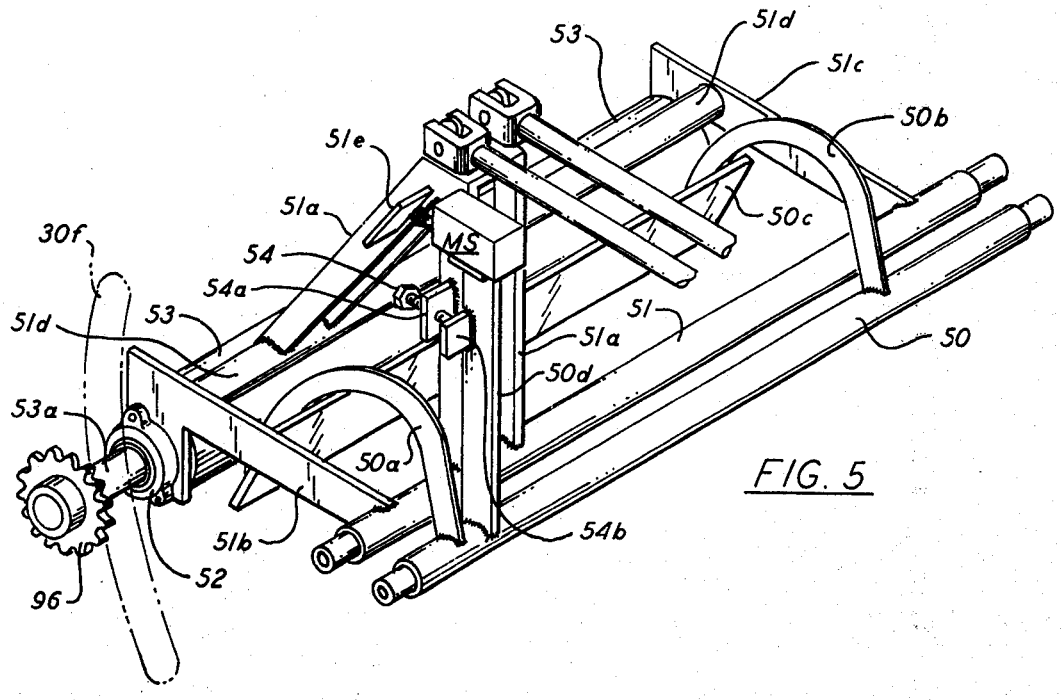

FIG. 5 is an isometric view of a portion of the assembly of FIGS. 1 – 4.

FIGS. 6*a*, 6*b*, and 7*a* to 7*e* are geometrical diagrams useful in understanding certain problems associated with rip-sawing.

Figure 8A:
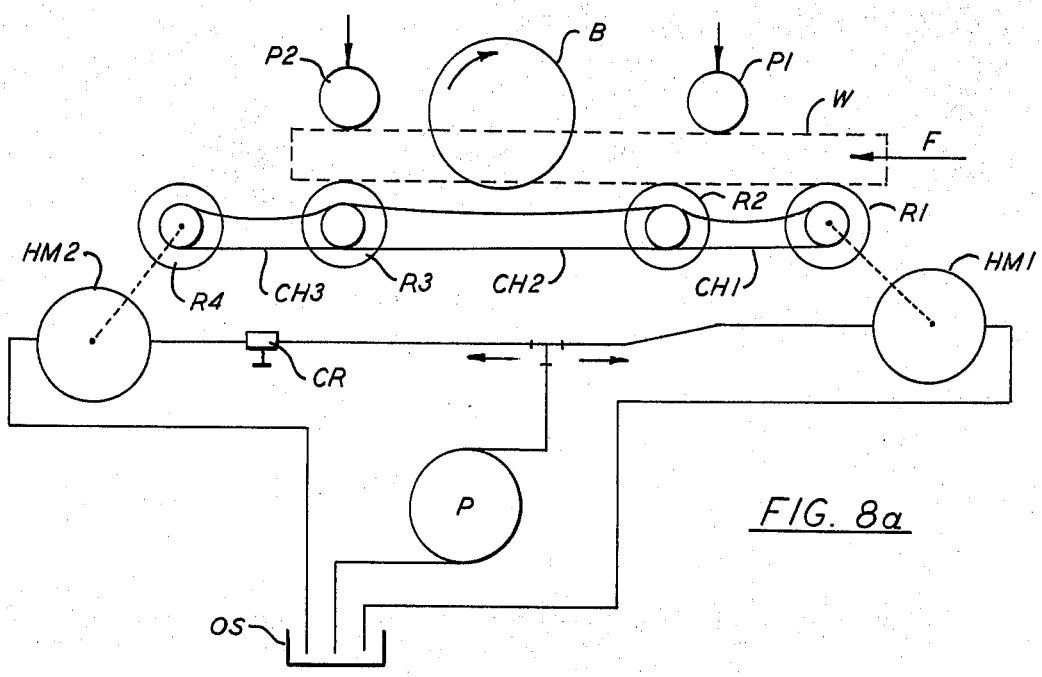

FIG. 8*a* is a schematic mechanical-hydraulic diagram illustrating one further form of the invention.

Figure 8B:
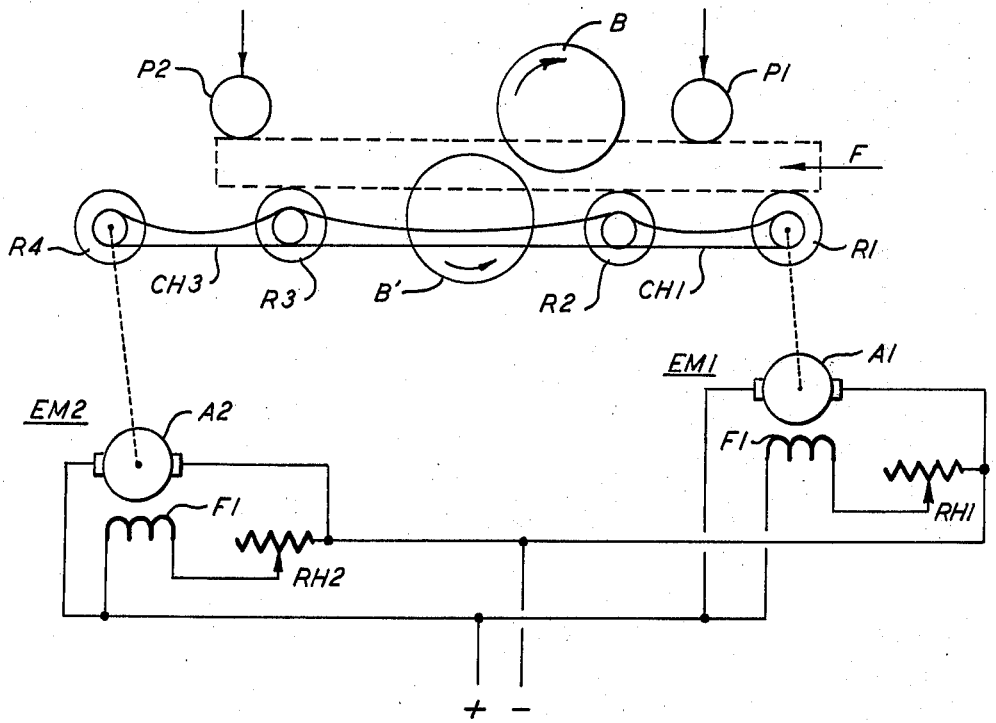

FIG. 8*b* is a mechanical-electric schematic diagram illustrating yet another form of the invention.

Figure 6A:
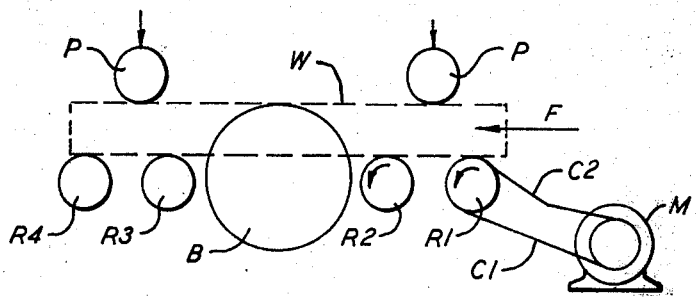
Figure 6B:
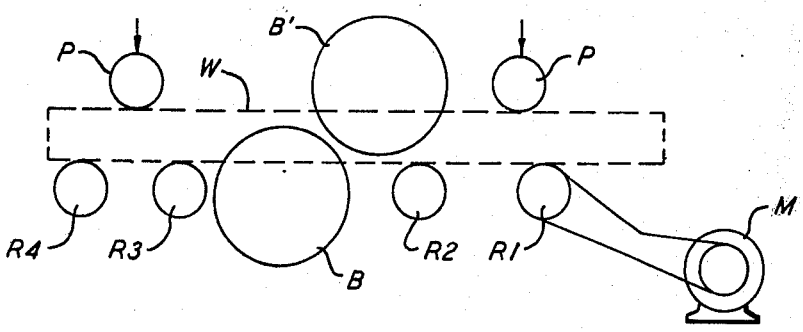

A better insight into various problems which are overcome by the present invention may be had by an initial consideration of the diagrams of FIGS. 6*a* and 6*b*. In FIG. 6*a* a piece W of wood is assumed to be fed in the direction of arrow F to and through a gang of saw blades, one of which is shown at B. The wood is fed by a group of lower feed rolls R1 to R4 against which it is pressed by a pair of pressure rolls P,P. While all of rolls R1 to R4 (and sometimes rolls P,P) are normally driven by a feed motor M, in FIG. 6*a* only feed roll R1 is shown driven, solely for sake of simplicity of explanation, by a chain having sections C1 and C2. The chain may be assumed to engage a sprocket on the end of the feed roll R1. In order to feed the wood forwardly, the feed rolls and motor M manifestly must turn counterclockwise. If appreciable slack exists in chain C, it will be apparent that its section C1 will be taut, and the slack will lie in section C2, as shown. Assuming first that blade gang B is rotated clockwise in FIG. 6*a*, it will be seen that a component of the blade forces imparted to the wood by the upper portions of the blades will act oppositely to the feed direction F. Blade forces depend upon the coefficient of friction between the wood and the blades, and upon the force with which the wood is pushed against the blades. If a saw tooth tends to snag in the wood, or if a portion of the wood begins to wedge between a pair of the blades, the blades will be seen to tend to push the wood rearwardly or at least to tend to decrease the forward speed of the wood. Any reduction in forward feed or any slight rearward movement of the wood will be seen to decrease the blade forces being imparted to the wood. Thus a system wherein the direction of blade forces is opposite to the direction of wood feeding tends to be self-governing or stable. Now assume instead that blade gang B is rotated counterclockwise in FIG. 6*a*, to provide climb cutting. Blade forces imparted to the wood then will tend to urge the wood forwardly. Forward acceleration of the wood will increase the tooth load and the friction forces applied to the wood, tending to provide further forward movement and even greater blade forces. If the drive chain had absolutely no slack, motor M would tend to resist forward acceleration of the wood, but with slack present in the chain, it will be apparent that blade forces of sufficient magnitude can accelerate the wood and the feed roll until the slack is removed. That amount of forward acceleration may allow blade forces to become so great that a high-speed ejection of the wood in the forward direction will occur. Thus such a climb cutting system, wherein blade forces aid wood forward feeding, tends to be divergent, so that high-speed ejection of the wood can occur, if slack in a feed roll drive chain will allow blade forces to appreciably accelerate the wood in the forward direction.

While FIG. 6a shows only one feed roll being chain driven for sake of simplicity of explanation, it will be recognized that plural feed rolls must be driven in practical applications. If roll R2 is chain driven from roll R1, R3 chain driven from roll R2, and roll R4 chain driven from roll R3, so that the rolls are cascaded in a chain-connection sequence, it will be seen that the problem is further aggravated. For example, when the wood has passed beyond roll R1, forward acceleration can increase, not only to remove slack from the upper course C2 of the chain shown, but also to remove slack from the chain (not shown) which interconnects rolls R1 and R2.

FIG. 6*b* corresponds to FIG. 6*a* except that a further arbor carrying a gang of blades has been added, one such blade being shown at B'. If only one blade gang of such a double-arbor saw uses climb cutting, a serious problem of high-speed ejection may not arise even with appreciable drive chain slack, since any tendency toward forward acceleration of the wood from forces by the climb cutting blades will tend to be offset by increased rearwardly-acting forces from the other set of blades. If both gangs of blades were arranged to perform climb cutting, the problem of high-speed ejection would be even worse than if a single arbor were used. Thus it will be seen that the problem of high-speed forward ejection tends to occur when a single-arbor saw uses climb cutting, or if both arbors of a double-arbor saw use climb cutting, if slack exists in a feed roll drive chain. The use of climb cutting has tended to be rare and unsatisfactory, despite the potential advantages of longer tooth life and reduced operating power which it can provide.

In the arrangements discussed in connection with FIGS. 6*a* and 6*b*, the runaway condition which climb cutting tends to cause can be avoided if the feed rolls will not allow blade forces to cause sudden increases in wood feed speeds, and if drive chain C had absolutely no slack, the mentioned problem of high-speed ejections would not often occur. In practice, it is ordinarily necessary that a plurality of feed rolls be provided on both the entry side and the exit side of the saw blades, and hence unless a large number of individual feed roll motors were used, which would be very expensive and complex, a plurality of feed roll drive chains must be provided. A drive chain ordinarily must include some slack so that one can train it around a pair of fixed-axes sprockets to install it. Theoretically one could mount the feed rolls in movable bearings and remove drive chain slack by re-positioning the feed roll bearings. However, as a practical matter it is necessary that the feed rolls be fixedly located relative to the saw arbor or arbors. The ends of the feed rolls ordinarily must be positioned with an accuracy of the order of 0.001 inch to accurately align each feed roll axis perpendicularly to the feed direction. It is also ordinarily desirable, in order to provide proper cutting, that a pair of the feed rolls be mounted with minimum clearance from the saw blades, to support the board as closely as possible to the locations where cutting takes place, which also tends to preclude use of shiftable feed rolls. Theoretically, one could provide an individual chain tightener on each feed roll drive chain, but this would be expensive, and it would require a large number of adjustments to be frequently made by the operator. Theoretically, one might avoid the problem caused by drive chain slack by driving each feed roll by means of gearing rather than by use of chains. However, such an arrangement would require the use of either very expensive large-diameter gears or the use of many small gears, and gear backlash would cause the same disadvantageous effects as chain slack unless expensive anti-backlash gearing was used. One "brute-force" prior art attempt to prevent high-speed wood ejection from a climb cutting single-arbor saw involved the use of greatly increased downward forces on the pressure rolls. That strategm has not been deemed successful, as it can cause the rolls to damage the wood, and it requires the use of substantially more feed motor power, a larger feed motor, and an undesirably heavy pressure roll operating mechanism.

Figure 7A:
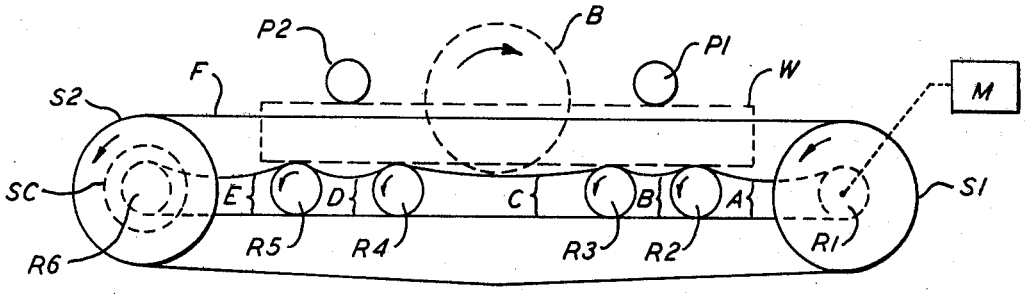

In FIG. 7*a* which diagrammatically illustrates portions of one simple embodiment of the invention, a plurality of feed rolls R1 through R6 are shown successively spaced apart between the entry end and exit end of a single-arbor saw. A piece of wood W (shown in phantom) is urged against the feed rolls by pressure rolls P1, P2, and fed leftwardly in FIG. 7*a* while being cut by a gang of saw blades represented at B. The generally leftward motion of the bottom portions of the saw blades urges the wood leftwardly, or forwardly, so that climb cutting is performed. The first feed roll R1 is schematically depicted as being driven directly by a motor M. Feed roll R1 is shown connected to drive feed roll R2 via chain A, feed roll R2 connected to drive feed roll R3 via chain B, and so forth, so that all six feed rolls R1 to R6 are driven at the same surface speed by motor M. The chains A to E are depicted as engaging the feed rolls themselves solely for sake of clarity, and it will be understood that in practice they will engage sprockets connected to the ends of the feed rolls.

In FIG. 7*a* it is to be noted that the lower courses of each of chains A to E are all shown taut, while their upper courses are all shown as including exaggerated amounts of slack. If saw blade forces are to increase leftward feed speed of the wood so as to cause the mentioned runaway condition, the forces must cause sudden increased counterclockwise rotation of those feed rolls then engaging the wood. However, since the lower courses of the chains A to E are all taut, it will be apparent that rotation of none of the feed rolls can be increased by merely taking up slack from the lower chain courses. Instead, in order to move the wood suddenly forwardly, the saw blade forces must exceed the force or torque which holds the lower courses of chains A to E taut. In order to maintain the lower courses of chains A to E taut, feed roll R6 is shown connected to receive a retarding torque which is applied from sprocket S2 to feed roll R6 via a slip clutch SC. Sprocket S2 is shown driven through chain F by sprocket S1 affixed to feed roll R1. It will be seen that sprocket S1 and feed rolls R1 to R6 all rotate at the same angular velocity (it being assumed that all of the feed rolls have the same diameter). In order to maintain the lower courses of chains A to E taut, sprocket S2 is provided with a slightly greater diameter, and one or several more teeth, than sprocket S1. Thus sprocket S2 rotates at a slightly lower angular speed than sprocket S1 and the feed rolls. Because it rotates at a lower speed than roll R6, sprocket S2 applies a drag or retarding torque to roll R6 through the slip clutch, in an amount dependent upon the slip-torque setting of the slip clutch. The retarding torque applied to roll R6 applies tension to the lower course of chain E so that any slack in chain E is moved to the upper course of that chain, and the retarding torque is transmitted back from roll R5 successively to rolls R4, R3, R2 and R1, also removing slack from the lower courses of each of chains D through A. The mentioned difference in diameter (and number of teeth) between sprockets S1 and S2 also tends to maintain the upper course of chain F taut, and to maintain any slack in chain F in the lower course of chain F, where an exaggerated amount of slack is shown. In FIG. 7*a* the links in the upper course of chain A move toward roll R2, while those in lower course move away from roll R2. Thus the upper course of chain A may be termed an "input" chain course relative to roll B and the lower course of chain A termed an "output" course relative to roll B. Torque is applied from roll R1 to drive roll R2 by applying tension to the lower or "output" course from roll R2. Thus the function of the chain-tightening system shown in FIG. 7*a* may be characterized as that of removing slack from the output course of the chain associated with each chain-driven feed roll. While the assumption has been made in FIG. 7*a* that all of the feed rolls have the same diameter, that is in no sense a requirement of the invention, and it is only necessary that the various feed rolls have the same surface or peripheral speed. Any of the feed rolls may be increased or decreased in diameter relative to the other feed rolls if the sprocket directly connected to drive it is similarly increased or decreased in diameter (and number of teeth, of course).

Figure 7B:
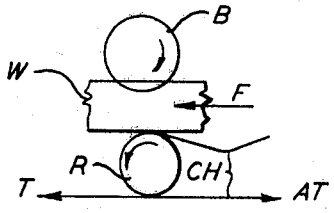

Basic principles of the invention may be understood more fully by consideration of FIG. 7*b*. Forces imparted to wood W by blade B tend to move the wood in the feed direction indicated by arrow F. Feed roll R, which is driven by chain CH, is supplied with a retarding torque T acting in opposition to the advancing torque AT imparted by chain CH. Roll R in FIG. 7*b* can be deemed to represent any one of the chain-driven rolls R2 through R6 of FIG. 7*a*, with the advancing torque AT being that supplied by the lower courses of chains A through E, respectively, and the retarding torque being that supplied by the lower courses of chains B through E in the case of rolls R2 through R5, or that applied by the slip clutch in the case of the last roll R6.

Figure 7C:
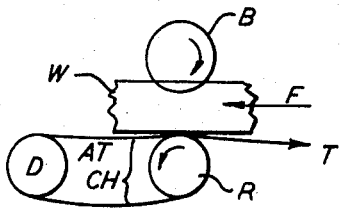

From a brief consideration of FIG. 7*c* it will become apparent that the retarding torque applied to a chain-driven feed roll need not act to remove slack from a lower chain course, but may instead maintain all slack in a lower chain course. In FIG. 7*c* roll R is assumed to be driven by chain CH from drive roll D, but, of course, one or more further rolls and chain courses could be interposed between rools D and R. Retarding torque T, which may be applied to roll R by a slip-clutch, by a brake, or by various other techniques to be described, will be seen to prevent blade forces from suddenly accelerating feed of wood W. FIG. 7*c* will be seen to illustrate the principles of an embodiment of the invention wherein drive power is applied to the last feed roll at the exit end of the saw, and transmitted back through cascaded chain connections to the first feed roll at the entry end of the saw. With such an arrangement, it will be apparent that the retarding torque may be developed by use of a pair of different diameter sprockets as in FIG. 7*a*, and applied to the first feed roll through a slip clutch, but that with such a reversed arrangement the sprocket on the last exit-end feed roll should have a slightly lesser diameter than the sprocket fixed to the first feed roll.

Figure 7D:
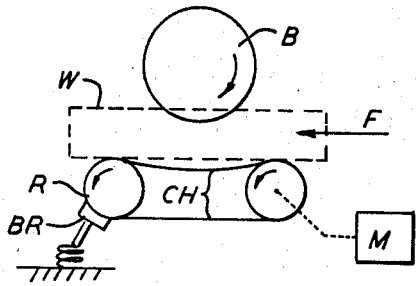
Figure 7E:
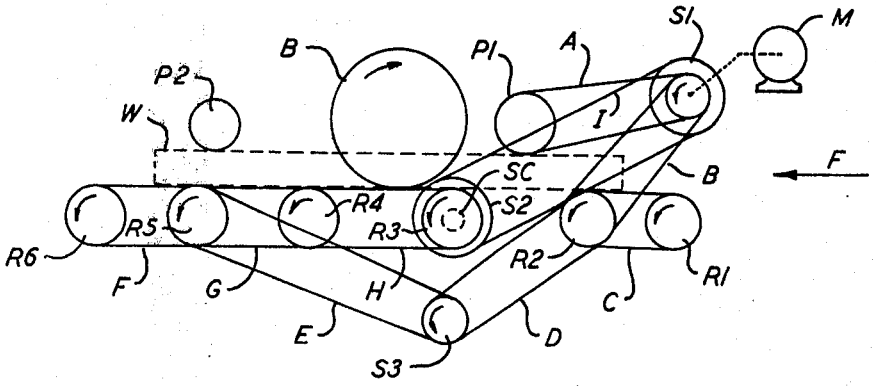

In an elementary embodiment of the invention illustrated in FIG. 7*d* feed roll R is advanced by chain CH, which is shown driven by another roll directly connected to motor M, and roll R receives a retarding force shown in schematic form as being applied by a stationary spring-actuated brake BR. An electrical eddy-current clutch or brake could be substituted. The retarding torque applied by brake BR maintains the lower course of chain CH taut, and blade forces cannot result in high-speed ejection unless they exceed the braking torque. However, if a stationary brake is used as illustrated in FIG. 7*d*, the power which is wasted and which must be dissipated by the brake is proportional to the product of braking torque and the rotational speed of roll R. To minimize the probability of a high-speed wood ejection it is desirable to apply ample braking torque, but that increases the amount of power wasted and tends to require a larger and more expensive brake. While such an arrangement may be deemed suitable in some applications, a slip clutch arrangement of the nature typified by FIG. 7*a* completely overcomes any such problem. In FIG. 7*a* the power which is dissipated in slip clutch SC depends upon the slip clutch slip-torque setting times the difference between the rotational speeds of the two faces of the clutch, i.e. the difference between the angular speed of roll R6 and sprocket S2. If sprocket S2 is provided with only a slightly larger diameter than sprocket S1 so that it revolves only slightly slower than sprocket S1 and rolls R1 to R6, it will be seen that the slip clutch may be provided with a large slip-torque setting and yet be required to dissipate only very modest amounts of power. In an exemplary embodiment to be described in detail, a pair of sprockets corresponding in principle to sprockets S1 and S2 used 15 and 16 teeth, respectively, with eminently satisfactory operation, although it is to be understood that wide departures in either direction from that ratio may be used within the scope of the present invention. In a typical application of the invention, a feed roll drive motor might be say a 3 horsepower motor, and a slip clutch employed in a 15:16 speed ratio arrangement then would dissipate only a small fraction of one horsepower. Slip clutches (sometimes called torque limiters) capable of such use are readily available, inexpensive and long-lasting. Also, the extremely small amount of power which need be dissipated in the slip clutch becomes completely negligible compared to the amount of arbor drive power which is saved by climb cutting. While the diagrams of the invention thus far discussed have assumed that the feed rolls are chain connected in the same sequence in which the wood passes through the assembly, or in an exactly opposite sequence as in FIG. 7*c*, and while such arrangements generally will be preferred, those particular sequences are not absolutely necessary to the invention. Also, idler sprockets and pressure-roll drive sprockets may be interposed in the sequence in which the feed rolls are chain-interconnected, in some embodiments of the invention the retarding torque may be applied to a feed roll other than the last roll in the sequence, and in a given saw assembly it is not absolutely necessary that all feed rolls be controlled by the retarding torque. FIG. 7*e* is provided merely to illustrate these principles. In FIG. 7*e* motor M drives a pair of sprockets one of which is connected by chain A to drive pressure roll P1. Pressure roll P1 is movable generally vertically in an arcuate path about the axis of the sprockets driven by motor M, and forced downwardly against the wood by a mechanism (not shown). Another sprocket driven by motor M drives feed roll R2 via chain B. Roll R2 drives feed roll R1 via chain C. Roll R2 also drives an idler sprocket S3 via chain D, and sprocket S3 drives feed roll R5 via chain E. Feed roll R5 drives feed roll R6 via chain F, and drives feed roll R4 via chain G. Feed roll R4 drives feed roll R3 via chain H. A further sprocket S1 driven by motor M drives sprocket S2 of slightly greater diameter than S1 via chain I, and sprocket S2 applies a retarding torque to feed roll R3 via slip clutch SC. With such an arrangement the output chain courses in chains B, D, E, G and H will be maintained taut, and thus the wood W cannot be accelerated by blade forces (not in excess of the retarding torque) when the piece of wood is engaged by any one or more of rolls R2, R3, R4 or R5. The retarding torque does not control chain C and roll R1, nor chain F and roll R6, but the wood will not be engaged by the saw blades when it is being fed by only roll R1 or only roll R6. The chains and feed rolls which are controlled by the retarding torque may be visualized as being connected in a closed-loop feedback control system. In FIG. 7*e* such a loop may be seen to extend from the motor input drive to chain B to the following elements: R2, D, S3, E, R5, G, R4, H, R3, SC, S2, I, S1, to the motor input.

In certain applications it may be deemed practical to interconnect a pair of feed rolls which are spaced quite closely together by means of a trio of gears rather than by a chain-sprocket connection. If a trio of gears (not shown) were used in lieu of chain G in FIG. 7*e*, with a pair of such gears mounted on the ends of rolls R4 and R5 and a third intermediate idler gear used to provide the same direction of rotation of both rolls, it can be deduced that the retarding torque applied by the slip clutch then would take up gear backlash in the same manner as it takes up chain slack. It should now be apparent that the invention may be used to take up slack, backlash or "play" between an input drive shaft and any one or more feed rolls driven thereby through chains, gears or any like mechanical connection having "deadspace," "play" or "slop," which condition will be referred to generically as "slack."

In accordance with a further embodiment of the invention, high-speed wood ejection is prevented by providing a retarding torque to a cascaded series of chain driven feed rolls by use of motor means in lieu of a slip-clutch or brake. In FIG. 8*a* a first hydraulic motor HM1 directly drives feed roll R1, and successive feed rolls R2, R3, and R4 are driven from roll R1 via chains CH1, CH2 and CH3 and sprockets on the four feed rolls. A second hydraulic motor HM2 is shown connected directly to the last feed roll R4, and because motor HM2 applies a drag or retarding torque to roll R4, the lower courses of the chains are maintained taut, and forces imparted to the wood W by blade B cannot cause high-speed ejection unless they exceed the retarding effect of motor HM2. In order that motor HM2 provide a drag or retarding force on roll R4, a controllable hydraulic restriction CR, such as an adjustable valve is provided in the supply line leading to motor HM2 from motor-driven hydraulic pump P, so that motor MM2 attempts to rotate at a slightly lesser speed than motor HM1. Pump P draws hydraulic fluid from a sump OS to which fluid is returned from the hydraulic motors. By adjusting the restriction CR, it will be apparent that one may adjust the magnitude of the retarding torque.

In FIG. 8*b* feed rolls R1 and R4 are instead driven by a pair of direct-current electric motors EM1 and EM2 which are shown as shunt motors. Motor EM1 includes an armature A1 and a field winding F1, and motor EM2 includes an armature A2 and a field winding F2. The field excitations of the two motors are shown adjusted by means of field rheostats RH1 and RH2. By reducing the field excitation of motor EM1 relative to that of motor EM2, so that motor EM1 tends to rotate faster than motor EM2, motor EM2 is caused to apply a retarding torque to roll R4, thereby controlling the slack in the feed roll chains to prevent high-speed wood ejection. In FIG. 8*b* climb cutting is shown being performed by two arbors merely by way of example. It is to be understood that the slip clutch system typified by FIG. 7*a*, the brake system explained in connection with FIG. 7*d*, the hydraulic system explained in connection with FIG. 8*a*, and the electrical system typified by FIG. 8*b* each may be used in either a single arbor saw having a climb cutting gang of blades, or in a saw having plural climb cutting arbors. Furthermore, each of those systems may be readily used in an arrangement where the retarding torque is applied to the last one of a selected series of feed rolls, or in the opposite manner explained in connection with FIG. 7*c*.

Referring now to FIGS. 1–5, a preferred form of saw assembly may be seen to comprise a parallel pair of heavy metal side plates 30*a* and 30*b* between which a variety of shafts and similar devices extend. The direction in which the side plates extend and in which wood passes through the machine will be termed the longitudinal direction, and the direction perpendicular thereto will be termed the lateral or transverse direction. The side of the machine shown in FIG. 2 will be termed the near side.

An in-feed table 31 comprises a pair of channel members 31*a*, 31*b* having their forward ends bolted to side plates 30*a*, 30*b* (as shown at 31*c* for channel 31*b* in FIG. 4). The rear ends of the in-feed table members 31*a*, 31*b* may be supported above the floor on simple legs (not shown), or may be bolted to any conventional conveyor device or other machine which transports wood to the saw. A plurality of in-feed rolls 32,32 are rotatably journalled in pillow-block bearings 33,33 carried atop members 31*a*, 31*b*. As shown in FIG. 3, each in-feed roll 32 is driven by a respective sprocket 34 and by roller chain 35 which extends in a closed sprocket housing 36 along in-feed table member 31*b*. Chain 35 is driven by sprocket 34*a* carried on shaft 29 which is driven by sprocket 86 (FIG. 2) in a manner to be described. An eccentric roller 37 bolted on one side plate 30*b* engages roller chain 35 to remove slack therefrom. The function of in-feed rolls 32 is to transport wood to the feed rolls of the machine prior to being sawed and hence the presence of slack in the chains driving rolls 32 is not of great importance.

Near the entry end of the machine a shaft 66 shown journalled between side plates 30*a*, 30*b* carries a plurality of pivotally-hung heavy metal bars 67,67 which function as a protective curtain. As wood is fed forwardly into the machine, it will inwardly deflect a number of the bars, rotating a number of them clockwise as viewed in FIGS. 2 and 4, until the ends of the bars rub along the upper surface of the wood. The number of bars which are deflected will depend, of course, upon the width of the wood, and the remainder of the bars will remain undeflected in their lowered position shown. Bar 68 (FIG. 4) extending across the machine prevents counterclockwise rotation of any of bars 67 from the position shown, and thus could prevent pieces of wood flung against the bars by the saw blades from exiting rearwardly from the machine at high velocity. Crank arm 67*a* (FIG. 2) attached to shaft 66 allows bars 67 to be raised inwardly in the event it is desired to remove a piece of wood rearwardly from the machine. It may be pointed out that provision of a heavy metal curtain such as that formed by bars 67 is deemed wholly unnecessary, as a practical matter at the entry end of the single-arbor climb cutting saw illustrated, since the tendency of such a saw is to throw wood forwardly, rather than rearwardly, for reasons already made apparent. However, a curtain of the type shown was used in the specific embodiment being described merely to comply with rather arbitrary governmental regulations requiring use of such as device adjacent the entry end of a resaw. Several such curtains are used in series on some resaws.

As wood is fed through the machine, it is laterally guided against either near-side guide rail 70*a* (FIG. 1) or far-side guide rail 70*b*, both of which are made laterally adjustable, to adjust the width of the outer cut made on either side of the saw. As shown in FIG. 1 each guide rail may be carried on a respective threaded block 71*a*, 71*b* carried on a respective threaded shaft, one of which shafts is shown at 72 in FIG. 1, connected to be rotated by means of crank coupling 72*b*. A sprocket 73 and chain 74 transmits the crank motion to a similar threaded shaft (not shown) near the other end of the guide rails to insure that the rails remain accurately aligned in the longitudinal direction. The use of such adjustable guide rails is well known and not part of the present invention.

Three entry feed rolls 38*a*, 38*b* and 38*c* (FIG. 4) are journalled at their opposite ends in bearings carried on the side plates, such as those bearings shown at 39 in FIG. 3, and three exit feed rolls 40*a*, 40*b* and 40*c* (FIG. 4) are similarly journalled by bearings such as those shown at 41 in FIG. 3.

The saw arbor or shaft 42 is journalled on the far side of the machine in bearing 43 (FIG. 1) carried on side plate 30*b* and in pillow-block bearing 44, and journalled at the near side of the machine in bearing 45 (FIG. 2) carried on a large circular metal plate 46. Plate 46 fits within a large circular hole through side plate 30*a* and is shown bolted thereto by means of three tabs 47,47 welded to plate 46. Removal of circular plate 46 allows saw blades B,B to be installed or removed from the saw arbor. The main arbor 42 carries a multi-groove pulley 76 (FIGS. 1 and 3) which is driven via a plurality of belts 77 from pulley 78 on the output shaft of a large electric motor M1, typically of the order of 100 horsepower. A plurality of circular saw blades B,B are mounted on the arbor, spaced apart by sleeve spacers in accordance with the desired width or widths to be cut.

As a piece of wood enters the machine, it is forced downwardly by a rotating entry-end pressure roll 53 (FIGS. 1 and 4) against the trio of lower in-feed rolls 38*a*, 38*b*, 38*c*, all of which rotate at the same peripheral speed. In order to accommodate wood of different thicknesses, the pressure roll 53 is made vertically movable, and means which sense the thickness of a piece of wood control the vertical position of the pressure roll.

As best understood by reference to FIG. 5, shaft 50 journalled between the side plates is provided with a pair of generally downwardly-extending arcuate arms 50*a*, 50*b* which support a sensor plate 50*c*, and an upwardly extending arm 50*d* which carries microswitch MS. Shaft 51 also journalled between the side plates carries a bracket 51*a* generally having the shape of an inverted V, and a pair of generally forwardly-extending arms 51*b*, 51*c*. Bar 51*d* extends between the outer ends of arms 51*b*, 51*c* and is welded to the forward legs of bracket 51*a*. Arms 51*b*, 51*c* carry bearings such as that shown at 52 to rotatably journal the shaft 53*a* of entry pressure roll 53. Shaft 53*a* extends through an arcuate slot 30*f* provided in side plate 30*a* (and shown in phantom in FIG. 5) to carry a drive sprocket 96 for pressure roll 53. A pair of pneumatic rams 54*a*, 54*b* (FIGS. 1 and 4) are connected between the upper end of bracket 51*a* and end plate 30*c*. Bracket 51*a* (FIG. 5) also carries a pad or finger 51*e* (FIGS. 4 and 5) which actuates switch MS.

When no wood is being fed into the machine, sensor plate 50*c* swings to its lower limit position, substantially the position shown in FIG. 4, closing contacts of switch MS, which operates a solenoid valve (within control box CB) to extend ram 54*a*, tilting bracket 51*a* forwardly and lowering pressure roll 53 to its lower limit position. As will become apparent from FIG. 4, feeding a piece of wood into the machine will raise sensor plate 50*c* in an amount dependent upon the thickness or height of the board, so that the bottom of sensor plate 50*c* rubs along the top of the wood. The consequent clockwise motion of shaft 50 swings switch MS away from pad 51*e*. Contacts of switch MS then operate solenoid valves to relieve pressure in ram 54*a*, and apply pressure to retract ram 54*b*, thereby rotating bracket 51*a* clockwise (in FIG. 4) about the axis of shaft 51 and thereby raising pressure roll 53 in an arcuate path. As sensor plate 50*c* and pressure roll 53 are raised, the lower edge of pressure roll 53 remains a predetermined fraction of an inch below the lower edge of the sensor plate. Thus as the leading end of a piece of wood passes sensor plate 50*c* and encounters pressure roll 53, the pressure roll is urged slightly upwardly, and because a given amount of compression of ram 57*a* represents a given amount of force, the pressure roll 53 will apply a predetermined amount of downward force to the wood, forcing it against lower feed rolls 38*a*, 38*b*, and 38*c*.

An exit pressure roll 57 (FIGS. 1 and 4) is journalled in bearings in a pair of plates 57*b*, 57*c* rigidly spaced apart by members shown as pipes 57*d* (FIG. 4). Plates 57*b*, 57*c* are pivotally mounted on shafts 58 and 59 to which links 60 and 61 pivotally mounted at 62 and 63 are connected. Ram 64 is connected between link 61 and the machine frame. The shaft 57*a* (FIG. 1) of pressure roll 57 extends through arcuate slot 30*g* (FIG. 2) in side plate 30*a*, to carry drive sprocket 99 (FIG. 2) for exit pressure roll 57. As the sawn leading end of the wood exits from between the saw blades, it interrupts a beam of light which normally extends from lamp LS (FIGS. 3 and 4) on the far side of the machine to photosensor PS (FIG. 2) on the near side of the machine, thereby operating a further solenoid valve (not shown) to retract pneumatic ram 64, thereby lowering pressure roll 57 onto the partially sawn wood to force it against lower out-feed rolls 40*a*, 40*b* and 40*c* (FIG. 4). The precise pressure roll arrangement shown is not an essential feature of the present invention, and various other known pressure roll arrangements may be used.

The six lower feed rolls 38*a*, 38*b*, 38*c*, 40*a*, 40*b* and 40*c*, and the upper pressure rolls 53 and 57 are all driven in synchronism, by means of a roller chain-sprocket arrangement. While the vertically-movable pressure rolls 53 and 57 are shown connected to be chain driven in the specific embodiment being described, it is important to recognize that the pressure rolls may constitute vertically-movable idler rolls which are driven solely by their engagement with the wood workpiece in some embodiments of the invention. As shown in FIGS. 1 and 3, feed drive motor M2 drives a gear speed-reducer RG via belt 80. Shaft 81, shown largely cut away in FIG. 1, is coupled to the gear reducer output shaft and rotatably journalled in side plates 30*a*, 30*b*, and it thus transmits drive power to sprocket 83 (FIGS. 1 and 2) on the near side-plate 30*a*. Rotation of sprocket 83 drives chain 84, which engages five further sprockets 85 and 89, each of which are carried on shafts rotatably journalled in respective bearings carried on side plate 30*a*, the bearings for stub shafts carrying sprockets 85 and 88 being shown at Ξ′ and 88′ in FIG. 2. A sprocket 95 (not visible in FIG. 2) situated beside and keyed to the same shaft as sprocket 85 drives sprocket 96 on the shaft of entry pressure roll 53 via chain 97, and sprocket 98 keyed to the same shaft as sprocket 88 drives sprocket 99 on the shaft of exit pressure roll 57 via chain 100. The arcuate motion of entry pressure roll 53 and sprocket 96 occurs about the axis of the shaft carrying sprocket 85, and the arcuate motion of exit pressure roll 57 occurs about the axis of the shaft which carries sprockets 88 and 98, and hence chains 97 and 100 remain taut as the pressure rolls are raised and lowered. Sprocket 89 comprises an idler sprocket.

Sprocket 90 keyed with sprocket 86 on the shaft end of the first entry feed roll 38*a* is connected to the outer one 91*a* of two sprockets 91*a*, 91*b* carried side by side on the shaft 38*b*′ of the second entry feed roll 38*b* via chain 92, and the inner sprocket 91*b* (not visible in FIG. 2) is connected to the inner one 93*b* of two sprockets 93*a*, 93*b* carried on the shaft 38*c*′ of the third entry feed roll 38*c* via chain 94. The outer sprocket 93*a* on the shaft 38*c*′ of third entry feed roll 38*c* is connected to the outer one 101*a* of two sprockets 101*a*, 101*b* keyed to the shaft 40*a*′ of the first exit feed roll 40*a* via chain 102, and the inner sprocket 101*b* is connected to the inner one 103*b* of two sprockets 103*a*, 103*b* keyed to the shaft 40*b*′ of the second exit feed roll 40*b*, via chain 104. The outer sprocket 103*a* is connected to sprocket 105 keyed to the shaft 40*c*′ of the third exit feed roll 40*c* by means of chain 106. Though mounted concentrically, sprockets 87 and 105 are not keyed to a common shaft, but instead interconnected by a slip clutch SC, such as a commercially available torque limiter of the Morse 250A-700A series made by Morse Chain Division of Borg-Warner Corporation, or a similar device. In the specific embodiment being described, and as semi-diagrammatically shown in FIG. 2*a*, the shaft of feed roll 40*c* extends through a bearing in side-plate 30*a* and was keyed to both the body 109 of the slip clutch SC and to sprocket 105. Sprocket 87 is slidingly centered on the body of the slip clutch by pilot ring 110, and gripped between rings 111, 112 of clutch facing material. A disc compression-spring ring 113 is interposed between adjustment nut 114 threaded on the clutch body and pressure plate or ring 115, thereby urging the friction facing against both sides of sprocket 87. Cap screws 116 extending through the adjustment nut allow the slip-torque to be readily adjusted. A variety of different slip-clutches can be used without departing from the invention. The arrangement illustrated in FIG. 2*a*, wherein sprocket 87 is gripped between faces of the slip clutch, may vary when other forms of slip-clutch are used, and it is not necessary that a slip clutch frictionally engage sprocket 87 itself. The type of slip clutch shown conveniently allows sprocket 105 to be keyed to the feed roll shaft even though the slip clutch is mounted in between sprocket 105 and the feed roll. Other forms of slip clutch having input and output hubs which frictionally engage each other may be used, with one such hub being keyed to the feed roll shaft and sprocket 105, and the other hub being fixedly fastened to sprocket 87. The connections involving chains 92, 94, 102, 104 and 106 will be seen to drive all the feed rolls at the same angular velocity. However, because sprocket 87 is provided with a slightly greater diameter and a slightly larger number of teeth than sprocket 86, so as to rotate at a slightly smaller angular velocity, slip clutch SC applies a retarding torque to the last feed roll, and through chains 106, 104, 102, 94 and 92 to the other feed rolls, thereby preventing the saw blades from accelerating a wooden workpiece to cause a high-speed ejection.

While all of the feed rolls are shown in FIGS. 1–4 as being driven on what has been termed the near side of the saw assembly, it will be apparent that the chain-sprocket connections could instead be made on the far side of the machine on some or all of the feed rolls to provide equivalent operation.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the inventon in which an exclusive property or privilege is claimed are defined as follows:

1. In a wood saw assembly which includes a plurality of feed rolls adapted to feed a piece of wood through a gang of rotating circular saw blades carried on a motor-driven arbor, wherein said feed rolls are cascadedly interconnected in a series sequence by a plurality of endless drive chains to rotate in synchronism, and feed motor means are connected to rotate a first of said feed rolls of said series and through said drive chains to rotate the others of said feed rolls of said series, the combination of means for applying a retarding torque to a last of the feed rolls of said series, thereby to prevent forces imparted to said piece of wood by said saw blades from accelerating said piece of wood in the direction in which said piece is being fed by said feed rolls despite the presence of slack in one or more of said endless drive chains.

2. The combination according to claim 1 wherein said means for applying a retarding torque comprises a slip clutch.

3. The combination according to claim 1 wherein said means for applying said retarding torque comprises braking means.

4. The combination according to claim 1 wherein said means for applying said retarding torque comprises a second motor means connected to said last of said feed rolls, and means for reducing the drive of said second motor means relative to that of said feed motor means so that said feed motor means drives said second motor means.

5. The combination according to claim 1 wherein said means for applying said retarding torque is connected to be driven by said feed motor means.

6. The combination according to claim 2 wherein said means for applying said retarding torque includes a sprocket driven at an angular velocity less than the angular velocity of said last of said feed rolls, and said slip clutch is connected to transmit said retarding torque from said sprocket to said last of said feed rolls.

7. The combination according to claim 4 wherein said feed motor means and said second motor means each comprise a hydraulically-powered motor, and said means for reducing the drive of said second motor comprises fluid flow control means.

8. The combination according to claim 4 wherein said feed motor means and said second motor means each comprise an electric motor having a field winding, and said means for reducing the drive of said second motor comprises means for controlling the excitation of the field winding of at least one of said motors.

9. In the method of rip-sawing wood which comprises feeding a piece of wood forwardly through a gang of saw blades driven in a direction such that blade forces imparted to said piece of wood tend to urge said piece of wood forwardly, said step of feeding comprising rotatably driving at least one feed roll through a motion-transmitting mechanism to urge said piece of wood forwardly at a predetermined speed, the added step of applying a retarding torque to the motion-transmitting mechanism rotatably driving said feed roll to take up slack in said mechanism, thereby preventing blade forces which do not exceed said retarding torque from forwardly accelerating said piece of wood to a speed greater than said predetermined speed.

10. The method according to claim 9 wherein said step of applying said retarding torque comprises applying a frictional torque to said feed roll through a slip clutch driven at an angular velocity less than the angular velocity of said feed roll.

11. A wood saw assembly, comprising, in combination: circular saw blade means; means for rotating said saw blades; feed roll means for feeding a piece of wood in a forward direction through said saw blades, said saw blades being rotated in a direction such that forces imparted to said piece of wood by said saw blades tend to urge said piece in said forward direction; motive means; motion-transmitting means connecting said motive means to drive said feed roll means; and means for applying a retarding torque to a portion of said motion-transmitting means which is connected to said feed roll means, whereby blade forces imparted to said piece of wood will not accelerate said piece of wood in said forward direction unless they exceed a magnitude determined by the magnitude of said retarding torque despite the presence of slack in said motion-transmitting means.

12. The assembly according to claim 11 wherein said motion-transmitting means comprises sprocket means and endless chain means.

13. The assembly according to claim 11 wherein said motion-transmitting means includes a series of sprockets interconnected by a series of drive chains, the first sprocket of said series of sprockets being connected to be driven by said motive means, said retarding torque being applied to the last sprocket of said series of sprockets.

14. The assembly according to claim 11 wherein said means for applying said retarding torque comprises a slip clutch.

15. The assembly according to claim 11 having translatable pressure roll means adapted to force said piece of wood against said feed roll means.

16. Apparatus according to claim 11 wherein said means for applying said retarding torque comprises a motor connected to said portion of said motion-transmitting means.

17. Apparatus according to claim 13 having a rotatable member driven at an angular velocity differing from the angular velocity of said feed roll means, said slip clutch being connected to transmit said retarding torque from said rotatable member to said feed roll means.

18. The assembly according to claim 15 having sprocket means connected to said pressure roll means, said sprocket means being connected to be driven by said motive means.

* * * * *